United States Patent [19]

Wittern

[11] 4,284,206

[45] Aug. 18, 1981

[54] CAROUSEL DISPENSING APPARATUS

[76] Inventor: Francis A. Wittern, 1616 Casady, Des Moines, Iowa 50318

[21] Appl. No.: 73,002

[22] Filed: Sep. 6, 1979

[51] Int. Cl.[3] ..... G07F 11/06; G07F 11/54

[52] U.S. Cl. ..... 221/90; 221/121

[58] Field of Search ..... 221/86, 90, 119, 120, 221/121, 122

[56] References Cited

U.S. PATENT DOCUMENTS

| | | | |
|---|---|---|---|
| 1,644,371 | 10/1927 | Goldman | 194/7 |
| 1,835,605 | 12/1931 | Larsen et al. | 221/121 |
| 2,208,298 | 7/1940 | Mahaffey | 221/86 |
| 2,643,169 | 6/1953 | Wells et al. | 221/119 X |
| 3,179,289 | 4/1965 | Moyer et al. | 221/121 |
| 3,260,406 | 7/1966 | Ezzell | 221/122 |
| 3,589,556 | 6/1971 | Wittern | 221/90 |
| 3,767,081 | 10/1973 | Wittern | 221/90 |
| 4,069,943 | 1/1978 | Fawcett | 221/121 X |
| 4,142,883 | 3/1979 | Dichter | 221/11 X |

FOREIGN PATENT DOCUMENTS

| | | | |
|---|---|---|---|
| 192714 | 9/1923 | United Kingdom | 221/86 |

*Primary Examiner*—F. J. Bartuska

*Attorney, Agent, or Firm*—Henderson & Sturm

[57] ABSTRACT

A product dispensing apparatus of a coin operated type is provided with a housing having a product delivery compartment attached thereto. A frame structure is rotatably mounted within the housing and has a plurality of product column assemblies mounted in a carousel arrangement. Each of the product column assemblies has a set of shelves, each shelf pivotally attached thereto and oriented one above another in each column for allowing a product to be placed thereon for dispensing, one at a time. A radially extending partition wall is disposed on each side of each set of shelves for preventing the product from being moved off of the shelf. Each of the shelves is a generally pie section shaped configuration with side wing members that fold so that such shelves do not become wedged between the partition walls when they drop towards a product dispensing position. A motor is provided for turning the carousel for selection of particular product desired and a delivery system is provided for delivering the product upon insertion of the proper amount of money into the machine and pushing a delivery button.

8 Claims, 14 Drawing Figures

CAROUSEL DISPENSING APPARATUS

BACKGROUND OF THE INVENTION

In the type of vending machine shown in U.S. Pat. Nos. 3,589,556 and 3,767,081, there are a plurality of rows of shelves, each row of shelves being actuated by a separate actuating mechanism. One of the common ways of actuating a machine of this type is to use a separate solenoid or a separate motor for each row of shelves. This is, however, an expensive thing to do and for that reason becomes an economic problem.

There are carousel vending machines in the prior art of a type which have a plurality of vertical rows of product and including structure for turning the rows about a central axis for selection and dispensing of the desired product for example as shown in U.S. Pat. Nos. 1,644,371; 1,835,605; 2,208,298; 3,179,289 and 4,069,943, but it has not become practical to combine the type of vending machine shown in U.S. Patent No. 3,589,556 with a carousel arrangement because there are certain problems which have not been overcome. One of these problems is that in using a carousel type of vending machine having a plurality of shelves pivotally attached and releasable there must necessarily be a close tolerance between the partition separating the rows of shelves and each set or row of shelves to prevent the product from falling between the shelf and the partition. This becomes a real problem in a carousel type of arrangement, since a pie shaped shelf is dictated by the carousel arrangement and such a shelf cannot drop properly to release the product because the wider portions of the pie shaped shelf catch on the partition as it begins to drop, thereby preventing such dropping of the shelf as is required. Consequently, there is a need for structures to alleviate this problem.

Another problem associated with the carousel type of vending machine when vertically disposed rows of shelves are used is that it is necessary for the rows to be viewed, preferably by using a motor to rotate the carousel and then to stop it at rather precise positions. Heretofore this problem has not been solved sufficiently to make such a machine commercially practical. Consequently, there is a need for structures to solve this problem.

Still another problem associated with this type of machine is a way to easily and positively set the prices for the product in each of the vertical rows of shelves. Accordingly, there is also a need for structures to solve this problem.

SUMMARY OF THE INVENTION

The present invention relates to a product sensing apparatus having a housing with a product delivery compartment attached thereto. A carousel frame structure is rotatably connected to the housing and a plurality of vertically oriented product column assemblies are attached to the frame around a vertical rotational axis of the frame. A vertically oriented set of shelves is attached to each of the product column assemblies and these rows of shelves are pivotally attached to such product column assemblies, each shelf in each row being oriented one above another and being moveable from a substantially horizontal product storing position to a non-horizontal dispensing position and back again. Radially extending partition walls are disposed on each side of each set of shelves. A mechanism is provided for rotating the frame means and thereby the columns of shelves about the vertical axis between a selection position and other rotational positions. A delivery mechanism is also attached to the housing for selectively causing the lowermost horizontally disposed shelf at the selection position to move to the non-horizontal dispensing position thereby delivering a product from such lowermost horizontally disposed shelf to product delivery compartment as desired. Folding shelves are provided to allow the shelves to move substantially unimpeded by the partition members from the horizontal to the non-horizontal position. Braking structure is provided for ensuring that the row of shelves selected for the selection position are precisely at such selection position and not slightly to one side or the other. A price setting mechanism is also provided for allowing simple and dependable price setting.

An object of the present invention is to provide an improved vending machine.

Another object of the invention is to provide a carousel machine having a plurality of pie shaped shelves thereon which will move substantially unimpeded from a horizontal product storing position to a non-horizontal product dispensing position.

A further object of the invention is to provide a braking mechanism for the above-identified type of vending machine whereby a carousel can be stopped at precise locations.

Still another object of the invention is to provide a simple and dependable price setting mechanism for the aboveidentified type of vending machine.

Other objects, advantages, and novel features of the present invention will become apparent from the following detailed description of the invention when considered in conjunction with the accompanying drawings.

DESCRIPTION OF THE PREFERRED EMBODIMENTS

Figure 1:
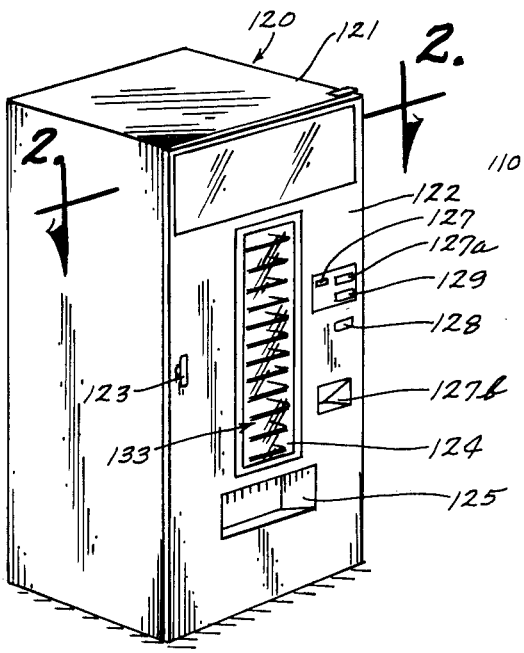
FIG. 1 is a perspective view of a vending machine constructed in accordance with the present invention.

Referring now to the drawings wherein like reference numerals designate identical or corresponding parts throughout the several views, a vending machine 120 is shown in a perspective view in FIG. 1. The vending machine 120 has a housing 121 generally in the shape of a box and a door 122 hingedly connected thereto. A locking mechanism 123 is provided for locking or unlocking the door 122. A central viewing window 124 is provided in the central portion of the door 122 for reasons which will be apparent below. Below the selection window 124 is a product delivery compartment 125, into which the products from the vending machine will drop into when such product is being dispensed and thereby delivered to a customer. A plate 126 is provided on the door which has a coin slot 127 therein for receiving coins. A coin return slot 127*b* is also provided in the door 122, as is customary for this type of vending machine. A window 127*a* in the plate 126 is provided and has the two lightbulbs shown in FIG. 12 therebehind for reasons which will be also explained below. A button 128 is provided for rotation of this structure 130 shown in FIG. 3, and a button 129 is provided for delivering the product once it has been selected, as will also be described in detail below.

Figure 3:
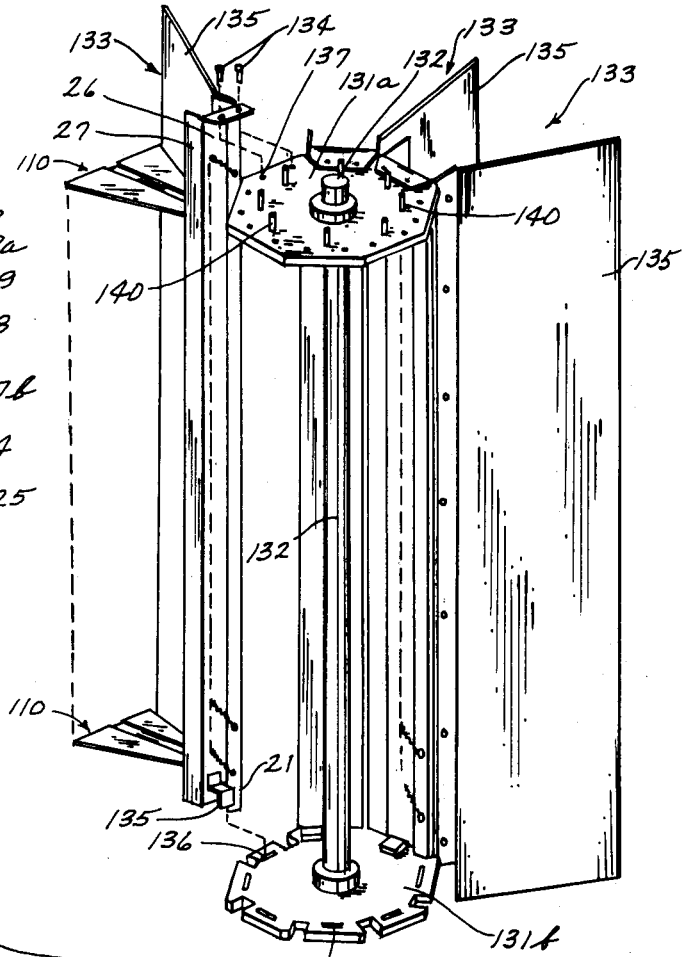
FIG. 3 is an enlarged exploded perspective view of a portion of the internal workings of the vending machine shown in FIG. 1.

Referring now with more particularity to FIG. 3, it is noted that the structure 130 includes a frame portion 131*a* and 131*b* rotatably mounted to the housing 121 by means of a central shaft 132. A plate 131*a* is fixed to a top portion and plate 131*b* to a bottom portion of the shaft 132. A plurality of product column assemblies 133 are attached to the top and bottom frame members 131*a* and 131*b* by means of bolt structures 134 and tabs 135 respectively. The tab 135 fits through an opening 136 in the bottom plate 131*b* and such tab 135 is welded to the plate 26 of the first product column assembly 133. Likewise the fastener members 134 fit through openings 137 in the top of plate 131*a*.

A portion of the product column assemblies 133 are protected under U.S. Pat. Nos. 3,589,556 and 3,767,081, both issued to F. A. Wittern. Consequently, rather than to discuss all of that operation separately in this patents patent, these patents are hereby incorporated by reference. Furthermore, identical numbers have been used on the corresponding parts of this disclosure as in U.S. Pat. No. 3,589,556, and any numbers in this patent less than 100 have corresponding parts in such last named patent. All of those numbers over 120 are new elements in the present invention.

Figure 2:
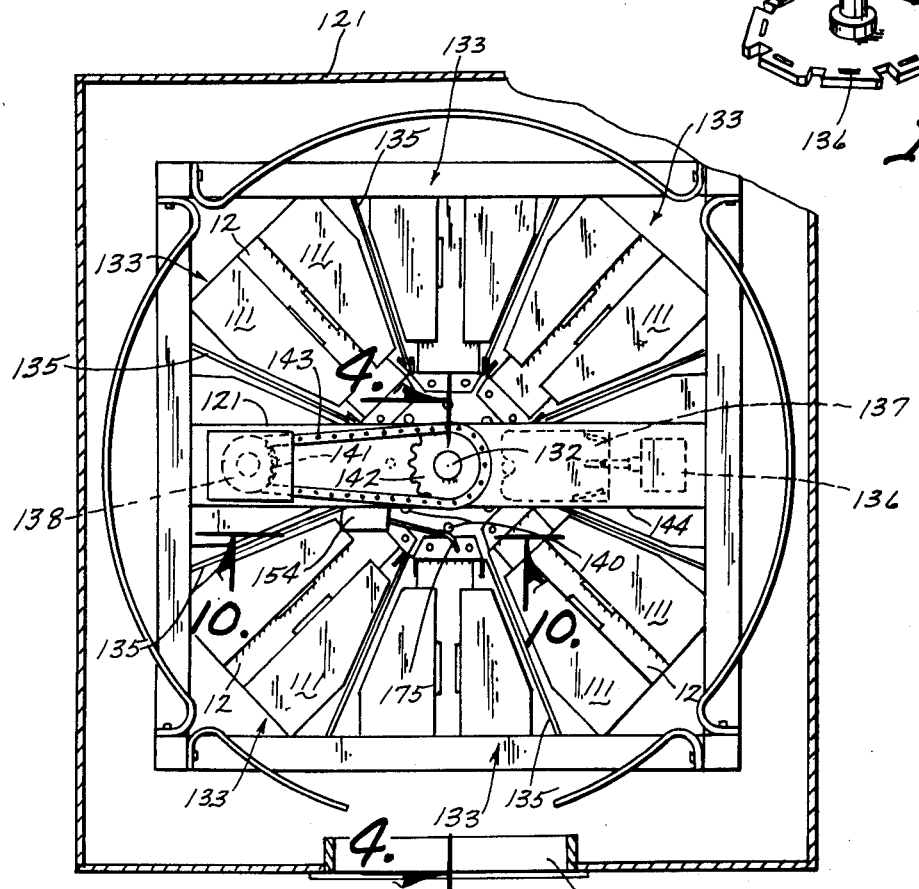
FIG. 2 is an enlarged cross-sectional view taken along line 2—2 of FIG. 1 and showing a top plan view of the mechanism within the housing of the vending machine shown in FIG. 1.

FIG. 2 shows the carousel arrangement of the product column assemblies 133 spaced around the inside of the housing 121. Radially outwardly extending partition walls 135 separate each of the sets of shelves 110 from the next adjacent set of shelves 110. It is to be understood that there could be one or more of such columns of shelves which are of a different shape if desired.

Looking at FIGS. 1 and 2 it can be seen that there is one of the columns 133 which can be viewed through the viewing window 124. If the customer desires to see the products in the other columns, he merely pushes the rotation button 128, which actuates the solenoid 136 to pull the braking plate 137 away from the pin assembly 140 and, at the same time, actuates the motor 138 which rotates the shaft 132 through sprockets 141, 142 and chain 143 wrapped around the sprockets 141 and 142. This, consequently, will rotate the frame members 131*a* and 131*b*; and, holding the button in 128 will cause the carousel frame to rotate continuously until a particular column of product is selected.

Figure 8:
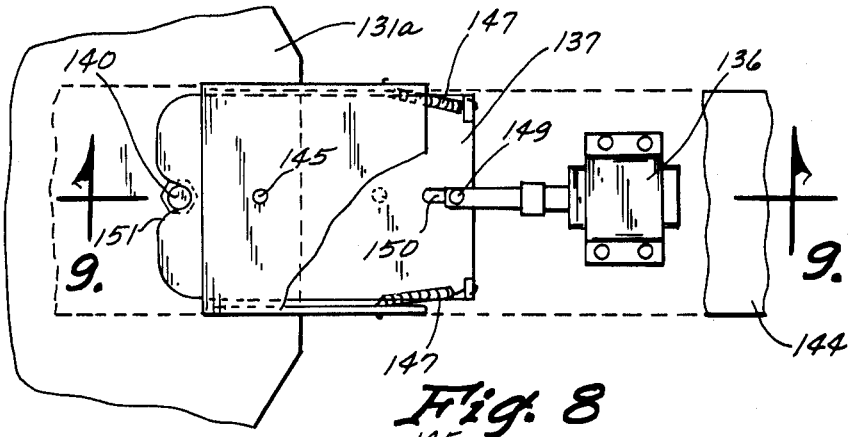
FIG. 8 is an enlarged plan view of the brake mechanism of the present invention.
Figure 9:
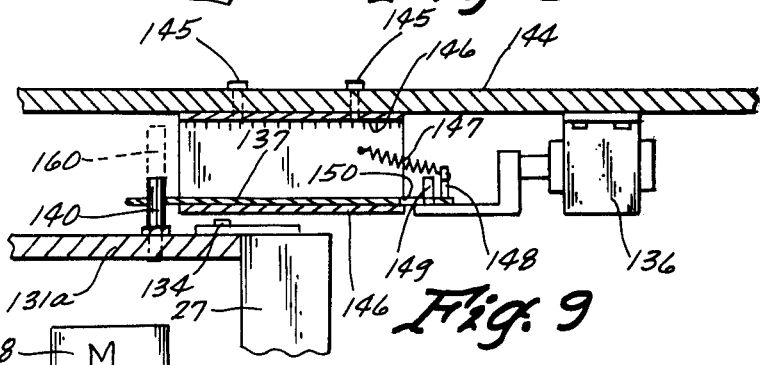
FIG. 9 is a cross-sectional view of the brake mechanism taken along line 9—9 of FIG. 8.

Referring more specifically to the brake mechanism shown in FIGS. 8 and 9, it is noted that the brake is connected to a portion of the housing 144 by means of fastening devices 145. The brake body 146 has the braking plate 137 disposed therein. A spring 147 connected to the body portion 146 and to a pin 148 connected to the other end of plate 137 biases the plate 137 to the position shown in FIGS. 8 and 9 whereby it will engage one of the pin structures 140 and hold the frame members 131*a* and 131*b* from rotation. The plate 137 rests slideably on the bottom portion of the housing 146. The solenoid 136 is connected by means of a pin 149 in a slot 150 in the plate 137 such that when the solenoid is activated it will pull the plate 137 towards the solenoid 136, thereby causing the plate 137 to move away from the pin 140 such that the slot 151 of the plate 137 is no longer around the post 140. Consequently, it should be clear that the plate 137 is normally biased to the position shown in solid lines in FIGS. 8 and 9, but when the rotation button 28 is pushed, not only the motor 138 is activated but also the solenoid 136 is activated such that when the motor 138 is rotating, the brake will be disengaged because the solenoid 136 will have the plate 137 pulled back towards the solenoid 136.

Figure 10:
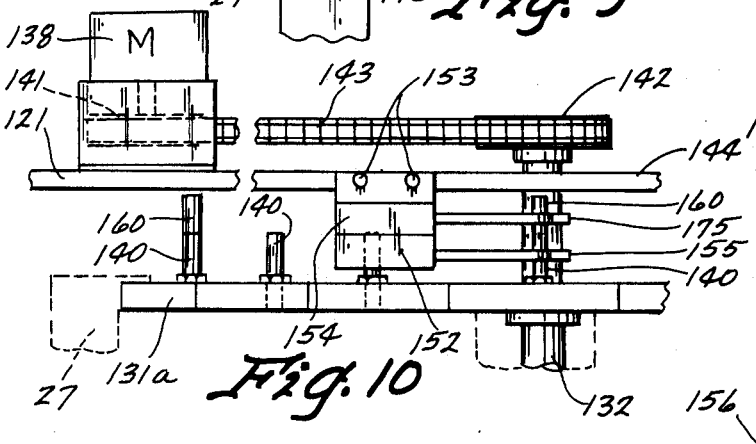
FIG. 10 is an enlarged view taken along line 10—10 of FIG. 2.

If the rotation button is pushed and then released, it will rotate to show the next adjacent product column assembly 133 and then stop. This is accomplished by means of a microswitch switching system which is shown best in FIGS. 10 and 12. A microswitch 152 is rigidly attached to a portion of the housing 121 by means of fastening devices 153 as is shown in FIG. 10. Additionally, a microswitch 154, which will be referred to later, is positioned just above the microswitch 152. The microswitch 152 has an arm 155 thereon which is biased to a normally opened position, as shown in solid lines in FIG. 12 and it is positioned such that it will be pushed to a normally closed position as shown in dashed lines in FIG. 12 when it comes in contact with the member 140 as shown in the position of FIG. 2. Consequently, when the rotation button 128 is pushed, the motor 138 will rotate the entire carousel system 130 until such time that the sensing arm 155 comes into contact with the next post 140 which is rotating around, assuming that the rotation button is not being held down constantly. Once the arm 155 contacts the post 140 and moves it from the normally open position shown in solid lines in FIG. 12 to the normally closed position shown in dashed lines in FIG. 12 and in solid lines in FIG. 2, then the rotation will stop and the next column will be in a position to be viewed through the viewing window 124. This process can be continued by momentarily pushing the rotation button 128 and allowing the machine to stop at the next position until all of the product column assemblies 133 have been viewed. Then a selection can be made as will be explained below.

Once the particular product column assembly has been chosen, such that the person desiring to use the vending machine has selected the product by viewing it through the window 124 there will be an indication on the machine of how much this particular product being viewed through the window 124 costs. The present invention will be explained as though there are items having only two specific prices thereon, although the invention obviously is broad enough to encompass any price or prices and any different number of priced items. For illustration purposes and simplicity the preferred embodiment is set up for items having a price of twenty-five cents and another item having a price of thirty cents.

Figure 5:
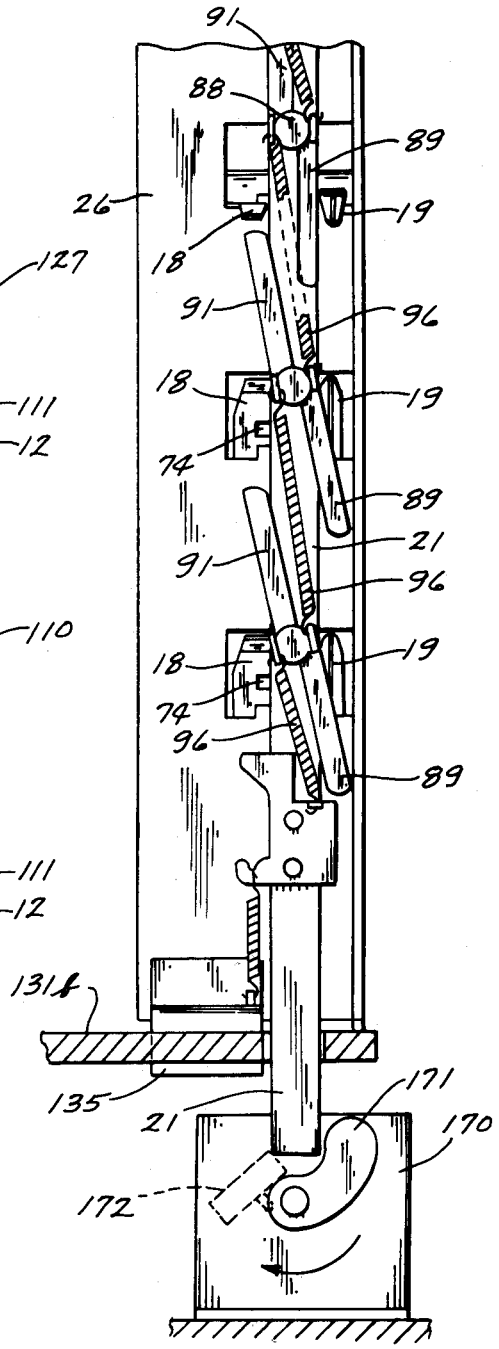
FIG. 5 is an enlarged partial cross-sectional view taken along line 5—5 of FIG. 4.
Figure 12:
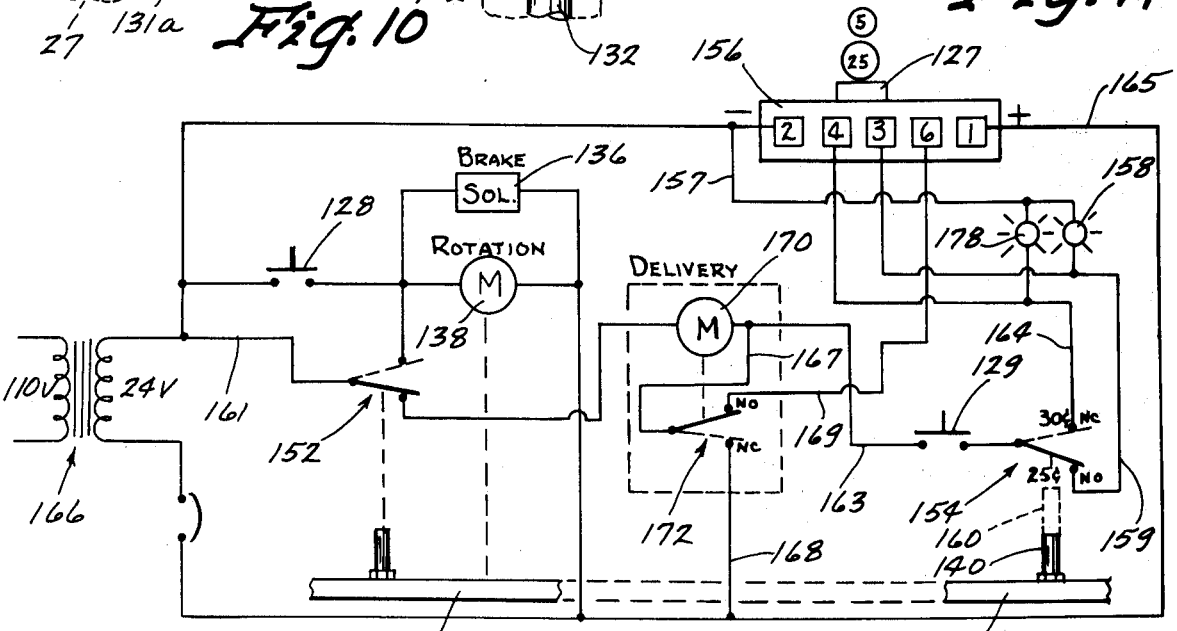
FIG. 12 is a schematic view of the electrical components of the first preferred embodiment of present invention.

If it is a twenty-five cent item that has been selected in the viewing window 124, then coins amounting to twenty-five cents need to be deposited into the coin slot 127 and thereby into a coin mechanism 156. Such coin mechanisms 156 are obviously well known to those in this art and thereby it is being shown schematically. The microswitch 154 shown in FIGS. 10 and 12 is biased to the normally open position shown in FIG. 12 so that if twenty-five cents is inserted into the slot 127, electrical contact will be made with the terminal 3 and electricity will flow through the electrical line 157, the light bulb 158 and the line 159 such that a light will appear through the window 127*a* to indicate that the delivery button is ready to be pushed. Consequently, once the light 158 is lit, then the button 129 would be pushed which causes the delivery motor 170 shown in FIGS. 5 and 12 to rotate a cam 171 through one revolution. When the cam 171 rotates through one revolution, it lifts the arm 21 to thereby drop the lowermost of the shelves 110 in the particular product column which is viewable through the window 124. This entire shelf dropping mechanism is clearly disclosed in U.S. Pat. No. 3,589,556 as was mentioned above so it will not be described in detail herein. A microswitch 172 is provided adjacent to the cam 171 such that the motor 170 will rotate only once and thereby deliver only one product for one price paid. It is noted in FIG. 12 that the microswitch 172 is biased to a normally open position as shown in solid lines in FIG. 12.

The terminals 1, 3, 4 and 6 are positive terminals in the coin mechanism 156 and the terminal 2 is a negative one. When twenty-five cents is put into the coin mechanism 156, a connection is made between the terminals 1 and 3 to cause a current to go through the bulb 158 and cause it to light up. Once this has been done, this is an indication that the product in the dealing window 124 is a twenty-five cent item and can be delivered by pushing the delivery button 129. Accordingly, when the delivery button 129 is pushed, power will be delivered to the motor 170 through positive terminal 3, line 159, microswitch 154, button 129 and line 163 to the motor 170 on the positive side and to the motor 170 on the negative side through lines 161 and 162. This will cause the motor to begin to rotate; and, when it does so rotate, the cam 171 will move the microswitch 172 from the normally open position shown in solid lines in FIG. 12, to the normally closed position shown in dashed lines in FIG. 12. When this happens, the connection through terminal 6 and line 169 is discontinued and this occurrance can be used to cancel the coin mechanism 156. The motor 170 continues to run because it is still being provided power on the positive side through the switch 172 through lines 168 and 165 and on the negative side, still through the line 161 and 162. Once the motor has made a complete revolution, the cam 171 will allow the switch 172 to move back to its normally open position shown in solid lines in FIG. 12. Alternatively, when this switching is made back to the terminal 6 then this occurrance can instead be used to cancel the amount registered on the coin mechanism 156.

Figure 11:
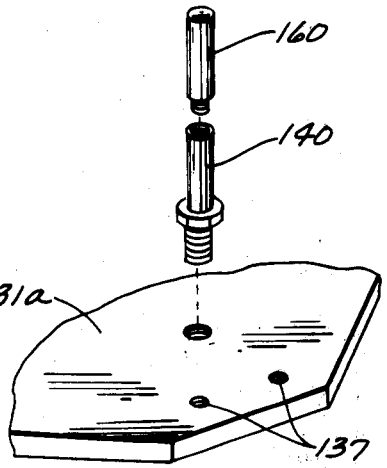
FIG. 11 is an enlarged perspective view of a sensing post and price setting mechanism of the present invention.

If it is a thirty cent item which is visible through the selecter window 124, then the switch 154 will be in the position shown in dashed lines in FIG. 12 (the normally closed position of the switch 154) because the feeler member 175 on the switch 154 will be in contact with the supplemental post member 160 as can be seen in FIGS. 10, 11 and 12. This post member 160 is threadably engaged into the post member 140 above whatever column it is desired to have a thirty cent item, rather than a twenty-five cent item. Consequently, the switch 154, through its sensing member 175, will have moved the switch 154 to the normally closed position if a thirty cent item is being viewed through the selecter window 124. Consequently, if twenty-five cents is all that has been inserted into the coin mechanism 156, then there will be no electricity through the bulb 178. Therefore, an item will not be delivered if the delivery button 129 is pushed. When another nickel is inserted into the coin mechanism 156 then the positive contact 4 will be electrically connected, as is well known in this art, to the negative contact 2, whereby electricity will flow from the electrical contact 2 through line 157, through the bulb 178 and back to the electrical contact 4, indicating that the delivery button can be engaged to get the product being viewed through the selecter window 127. Consequently, when the delivery button 129 is pushed, the motor 127 will begin to rotate because of receiving electricity on the positive side through the electrical line 163, delivery button 129, line 164 and positive contact 4 and on the negative side through negative line 161 and 162. As outlined above, once the motor 170 begins to rotate, the cam 171 (FIG. 5) will move the microswitch 172 from the normally open position shown in solid lines in FIG. 12 to the normally closed position shown in dashed lines shown in FIG. 12, at which time the motor will continue to rotate because it will be connected on the positive side through lines 168 and 165 to positive terminal 1 and on the negative side still through lines 161 and 162. The coin mechanism 156 will again be cleared when the switching occurs in microswitch 172 from normally open to normally closed because of the disconnection to positive terminal 6 of the microswitch 172. Once the motor rotates one revolution again, the cam will allow the microswitch 172 to move back to the position shown in solid lines in FIG. 12, such that the positive terminal 6 is connected to the positive side of the motor 170. There will not, however, be a complete circuit through the motor 170 at such time because the plus terminal 6 and the minus terminal 2 in the coin mechanism 156 will not be connected together. Consequently, the machine will be ready again for a customer to rotate the carousel to select an item, insert the appropriate amount of money until one of the lights 158 or 178 lights up, and then push the delivery button 129 to deliver the product to the product delivery chamber 125.

Figure 4:
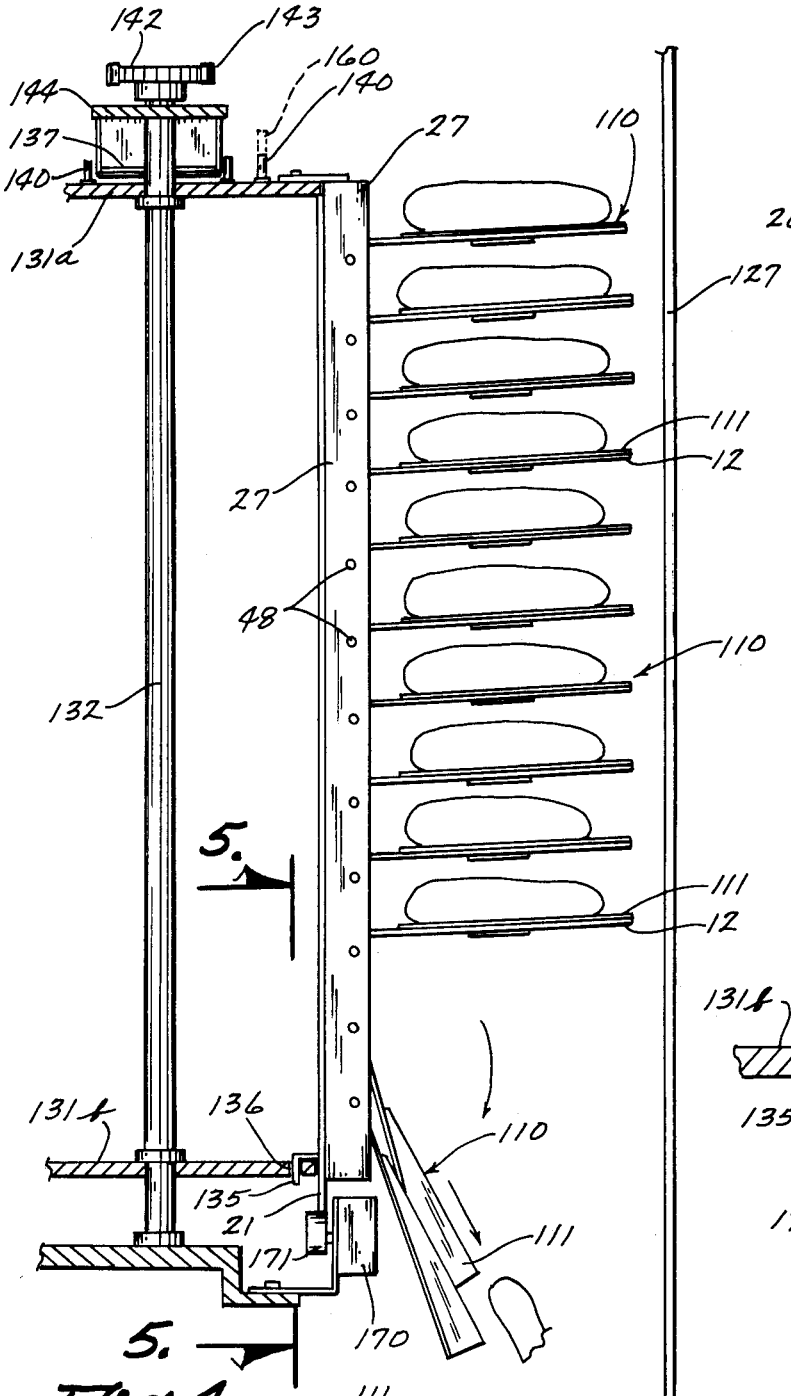
FIG. 4 is a partial enlarged cross-sectional view taken along line 4—4 of FIG. 2 and showing an item being dispensed from the vending machine.
Figure 6:
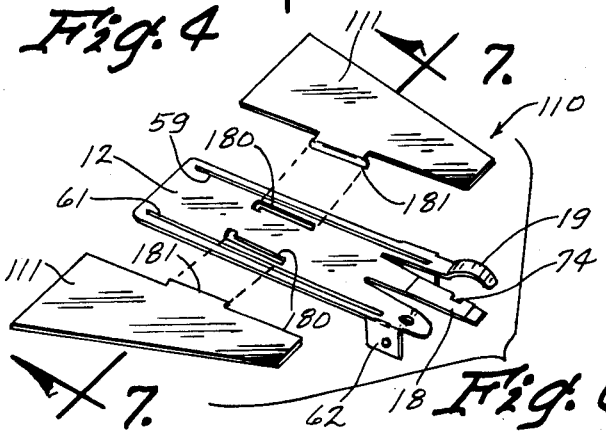
FIG. 6 is a perspective exploded view of a shelf for the vending machine.
Figure 7:
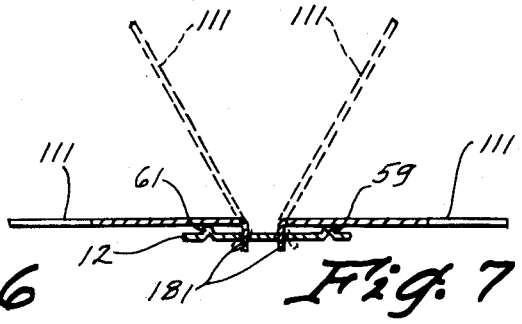
FIG. 7 is a cross-sectional view taken along line 7—7 of FIG. 6.

Referring now with more particularity to FIGS. 2, 6 and 7, it is noted that prior vending machines with this type of delivery system, such as shown in U.S. Pat. No. 3,589,556 were not of a carousel type and consequently when the inventor tried to use such structures in the carousel type of machine, there was a large space between the partitions 135 and the shelf 12. This was a problem because the product being dispensed could fall between the partition 135 and the shelf 12. When a solid shelf of the configuration shown in FIG. 2 was used, then such shelf would not drop down because as it tries to move downwardly, the shelf would come in contact with the partition members 135 and would still stick out too far to allow the shelf above it to function properly. Therefore, applicant devised a folding type of shelf 110 as shown in detail in FIGS. 6 and 7. This shelf 110 has a central portion 12 which is identical to the shelf 12 of U.S. Pat. No. 3,589,556, except that it has a pair of slots 180 disclosed therein. Flap members 111 are provided and have a complementary projection portion 181 which fits into the slots 180 in plate member 12 and allows the shelf members 110 to be maintained in a horizontal position when the shelf is up, for example as shown in FIG. 4, and allowing the flap members 111 to fold downwardly to the position shown in the lowermost portion of FIG. 4 and also shown in FIG. 7 once the product has been dispensed and the shelf 110 lowered. Consequently, when sufficient money has been placed into the machine and the delivery button 29 pushed, the lowermost horizontally disposed shelf 110 will be caused to be dropped from such horizontal position to the position shown by the two lowermost shelves 110 as shown in FIG. 4. Without such folding shelves, a carousel type of vending machine like that shown in U.S. Pat. No. 3,589,556 would be impractical if not impossible.

Figure 13:
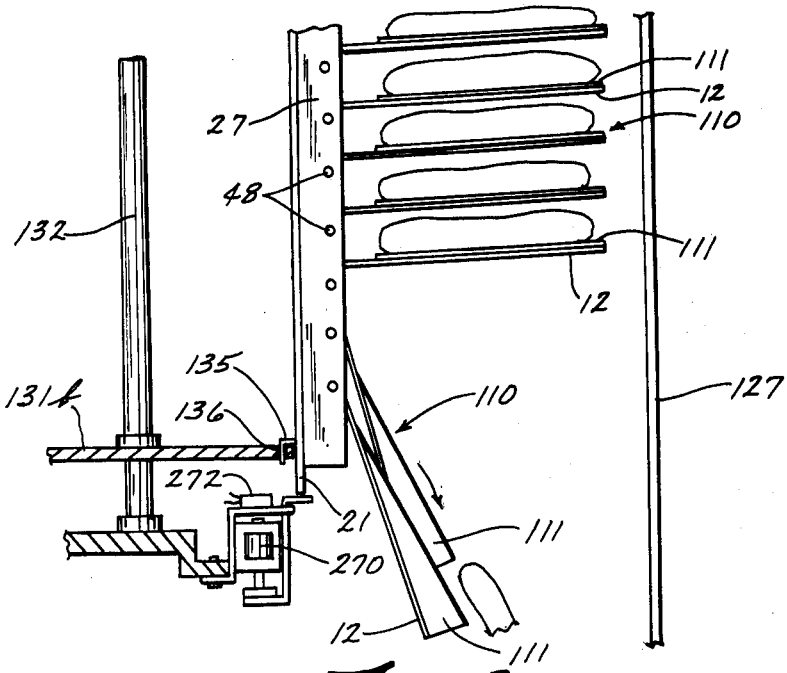
FIG. 13 is a view like FIG. 4, but showing a second preferred embodiment of the present invention.
Figure 14:
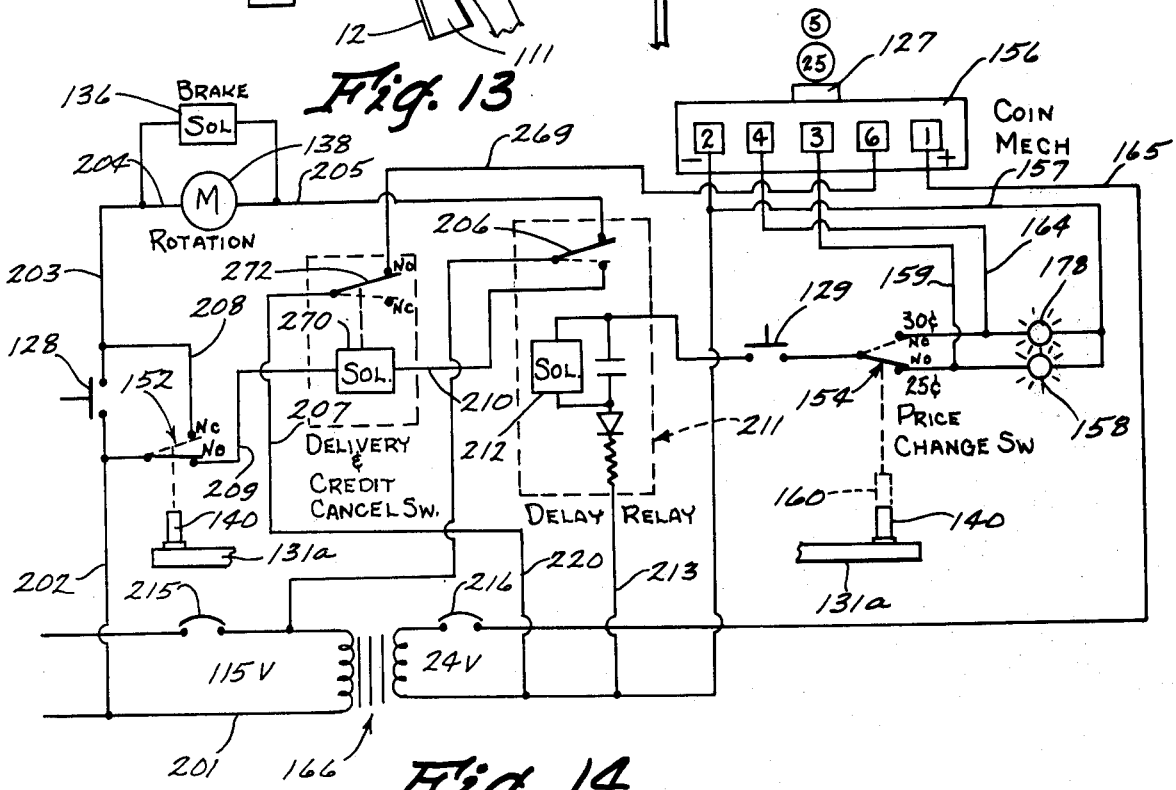
FIG. 14 is a schematic view of the electrical components of the second embodiment of the invention.

Referring now to FIGS. 13 and 14, a second embodiment of the present invention is shown. In FIG. 13 the mechanism shown is exactly like that shown in FIG. 4 except that instead of the use of a delivery motor 170 and cam 171, a solenoid structure 270 is used with an actuating member 271. When the solenoid 270 is inactivated it is in the position shown in FIG. 13, but when electric current is sent through the solenoid 270, then the member 271 will move upwardly from the position shown in 13 to push the actuating member 21 upwardly, as disclosed above, to cause the lowermost shelf 110 to drop a product therefrom.

If the rotation button 128 is pushed and then released, it will cause the entire carousel to rotate to show the next product column assembly 133 and then stop. This is accomplished by means of a microswitch system shown in FIG. 14. A microswitch 152 is rigidly attached to a portion of the housing 121 by means of fastening devices 153 as was shown in FIG. 10. Additionally, a microswitch 154, which will be referred to later, is positioned just above the microswitch 152. The microswitch 152 has an arm 155 thereon which is biased to a normally open position, as shown in solid lines in FIG. 14, and it is positioned such that it will be pushed to a normally closed position as shown in dashed lines in FIG. 14 when it comes in contact with the member 140 as shown in the position of FIG. 2. Consequently, when the rotation button 128 is pushed, the motor 138 will rotate the entire carousel system 130 until such time that the sensing arm 155 comes in contact with the next post 140, which is rotating around, assuming that the rotation button has not been held down constantly. The circuit to motor 138 is supplied from the negative side from electrical lines 201, 202, through button 128 to line 203 and 204 on the negative side, and on the positive side through electrical line 205, through a switch 206 which is biased to the position shown in solid lines in FIG. 14, and back to the positive side of the source of power 166 through a line 207. Once the arm 155 contacts the post 140, and moves the switch 152 from the normally open position shown in solid lines shown in FIG. 14 to the normally closed position shown in dashed lines shown in FIG. 14 and in solid lines in FIG. 2, then the rotation will stop and the next column will be in the position to be viewed through the viewing window 124. This process can be continued by momentarily pushing the rotation button 128 and allowing the machine to stop at the next position until all of the product column assemblies 133 have been viewed. Then any selection can be made as will be explained below.

Once the button 128 is pushed and the power from the negative side begins to go through the button 128, then the member 155 on the switch 152 will immediately drop off of the post 140 and cause switch 152 to move to the position shown in dashed lines in FIG. 14, at which time electricity will begin to flow through the switch 152 and to the line 208 and continue supplying power on the negative side to the motor 138 until such time that the next post 140 is encountered, at which time the post 140 will move the switch 152 back to the position shown in solid lines in FIG. 14, thereby cutting off the flow of electricity through the line 208 and, since the button 128 is in the outward position, no electrical flow will be going through this switch 128 either, thereby causing the motor 138 to be stopped.

Once the particular product column assembly has been chosen, such that the person desiring to use the vending machine has selected the product by viewing it through the window 124, there will be an indication on the machine of how much this particular product being viewed through the window 124 costs. The present invention will be explained as though there are items having only two specific prices thereon, although the invention is obviously broad enough to encompass any price or prices in any different number of priced items.

If it is a twenty-five cent item that has been selected in the viewing window 124, then coins amounting to twenty-five cents need to be deposited into the slot 127 and thereby into a coin mechanism 156 as shown in FIG. 14. Such coin mechanisms 156 are well known to those in this art and it is thereby being shown schematically. The microswitch 154, shown in FIGS. 10 and 14 is biased to the normally opened position shown in FIG. 14 so that if twenty-five cents is inserted into the slot 127, electrical contact will be made between the positive terminal 3 and positive terminal 1, whereby electricity will flow through the electrical line 157 to the negative terminal 2 and through the line 159 on the positive terminal 3 to the positive terminal 1 whereby the lamp 158 will be lit and such light will appear through the window **127*a* to indicate that the delivery button is ready to be pushed. Consequently, once the light 158 is lit, then the delivery button 129 would be pushed, which causes the delivery solenoid 270 shown in FIGS. 13 and 14 to move upwardly, thereby causing the member 271 to move the arm 121 upwardly, dropping the lowermost horizontally disposed shelf 110 down to deliver a product to the delivery compartment. The electricity flowing to the solenoid 270 is, on the negative side through lines 201, 202, the switch 152 and the line 209, and on the positive side through the line 210 and 207. When the button 129 is initially pushed, a solenoid 212 of a delay relay mechanism 211 is activated on the negative side through a circuitry line 213 and on the positive side through line 214, button 129, switch 154, line 159 to the plus terminal 3, which is connected to the plus terminal 1 when twenty-five cents is inserted in the machine. This delay relay switch shown in the box 211 is for the purpose of causing the solenoid to stay up longer even than just the time that the button 129 is pushed. When the solenoid 212 is activated, then the switch 206 is moved from the position shown in solid lines in FIG. 14 to the downward position shown in dashed lines, whereby electricity will flow to the delivery solenoid 270 on the negative side through lines 201, 202, switch 152 and line 209 and on the positive side through the line 210, through the switch 206, which has been in the position shown in dashed lines in FIG. 14, and then back down the line 207. Once the solenoid 212 stays for the predetermined amount of time, holding the switch 206 in the position shown in dashed lines in FIG. 14, then it will become inactivated automatically and move the switch 206 again to the position shown in solid lines in FIG. 14, whereby the connection between the lines 207 and 210 are disconnected on the positive side of the solenoid 270, thereby inactivating the delivery solenoid 270**.

During the process of the solenoid 270 moving between the lowermost position shown in solid lines in FIG. 13 and an uppermost position from that position whereby the ejecting mechanism 21 is moved upwardly, the switch 272 is utilized to either connect with the terminal 6 through the line 269 or not, thereby cancelling the amount of money registered on the coin mechanism each time this occurs. In other words, when the solenoid 270 is in the position shown in FIGS. 13 and 14 in solid lines, then the switch 272 connects the negative side through lines 220 and 269 to the coin mechanism cancelling structure 6, which is electrically connected on the other side of such mechanism 6 to the positive terminal 1. When the solenoid 270 moves upwardly from the position shown in FIG. 13, when it is activated, then the switch 272 is moved from the normally open position shown in solid lines shown in FIG. 14 to the normally closed position shown in dashed lines in FIG. 14, whereby the electrical connection between the lines 220 and 269 are disconnected, thereby disconnecting the negative side of the coin cancelling mechanism 6. Then, when the solenoid 270 is inactivated and drops back to the position shown in solid lines in FIG. 13, then the switch 272 is automatically moved to the position shown in solid lines in FIG. 14, whereby the negative side and lines 220 and 269 are connected together to cause current to pass through the coin cancelling mechanism 6.

When the item chosen and showing through the window 124 is a thirty-cent item, then the switch 154 will be moved to the position shown in dashed lines in FIG. 14, because the arm 175 will be in contact with the member 160. When this occurs, then the light 178 will go on, being supplied power on the negative side through the line 157 and on the positive side through the line 164 which is connected to the terminal 4, which terminal 4 is connected to the positive terminal 1 when thirty cents is inserted into the coin mechanism 156. When this light 178 is glowing through the window **127*a*, then this indicates that the delivery button 129 can be pushed to deliver a product. When the button 129 is pushed, the solenoid 212 is activated on the plus side by connection of terminal 1 to terminal 4, the line 164, the switch 154 and line 214, and on the negative side through the line 213. At this time, the switch 206 is moved from the position shown in solid lines in FIG. 14 to the position shown in dashed lines in FIG. 14, thereby activating the delivery solenoid 270, whereby power is supplied to the solenoid 270 on the plus side through the line 207, switch 206 and line 210, and on the negative side through the lines 201, 202, switch 152 and line 209. Again, the switch 272 is initially in the position shown in solid lines in FIG. 14, but when the solenoid 270 is activated, it moves upwardly such that the lever 121 is raised, thereby dropping the lowermost of the shelf 110 to deliver a product to the delivery compartment and at the same time, the switch 272 is moved to the position shown in dashed lines in FIG. 14 whereby the lines 220 and 269 are disconnected to disconnect the coin cancelling mechanism at terminal. Then, after the delay relay mechanism 211 inactivates the solenoid 212, the switch 206 drops back to the position shown in solid lines in FIG. 14, thereby cutting off the power to the solenoid 270 and causing the switch 272 to move back to the position shown in solid lines in FIG. 14 whereby power will again be supplied to the coin cancelling mechanism 6** to cause it to cancel the registration of the thirty cents that was registered thereon and ready the machine for its next use.

The lights 158 and 178 are optional and can be omitted if desired.

Circuit breakers 215 and 216 are provided to prevent the circuits from being overloaded.

Obviously many modifications and variations of the present invention are possible in light of the above teachings. It is therefore to be understood that, within the scope of the appended claims, the invention may be practiced otherwise that as specifically described.

I claim:

1. Product dispensing apparatus comprising:

a housing having a product delivery compartment attached thereto;

frame means rotatably connected to said housing;

a first product column assembly attached to said frame means;

a first set of shelves pivotally attached to said first product column assembly, the shelves of said first set being oriented one above another, each of the shelves of said first set of shelves having a substantially horizontal product storing position and a non-horizontal dispensing position;

a second product column assembly attached to said frame means;

a second set of shelves pivotally attached to said second product column assembly, the shelves of said second set of shelves being oriented one above another, each of the shelves of said second set of shelves also having a substantially horizontal product storing position and a non-horizontal dispensing position;

a radially extending partition wall disposed on each side of each set of shelves;

means on each of said shelves for allowing each respective one of said shelves to fold from an extended width when in the horizontal product storing position to a narrower width in the non-horizontal dispensing position;

means for rotating said frame means and thereby said first and second columns of shelves about a vertical axis between a selection position and at least one other rotational position; and delivery means attached to said housing for selectively causing the lowermost horizontally disposed shelf at said selection position to move to said non-horizontal dispensing position thereby delivering a product on said lowermost horizontally disposed shelf to said product delivery compartment.

2. The product dispensing apparatus of claim 1 wherein each of said shelves of said first and second set of shelves includes a plate member pivotally attached to one of the first or second product column assemblies, a first flap member pivotally attached to said plate member and means for causing said first flap member to be substantially parallel to the plate member in the substantially horizontal position of said shelves and allowing said first flap members to be non-parallel to the plate member in the nonhorizontal position thereof.

3. The product dispensing apparatus of claim 2 wherein each of said shelves of said first and second set of shelves includes a second flap member pivotally attached to said plate member and means for causing said first flap member to be substantially parallel to the plate member in the substantially horizontal position of said shelves and allowing said second flap member to be non-parallel to the plate member in the non-horizontal position thereof.

4. The product dispensing apparatus of claim 3 wherein each respective one of said shelves extends substantially from one position to each adjacent partition along a substantial portion of the length thereof whereby the product on each shelf will be prevented from falling between the shelf and a partition in the substantially horizontal position of said shelf.

5. The product dispensing apparatus as defined in claim 1 wherein said delivery means includes a single motor means for moving all of the shelves, one at a time, from the product storing to the product dispensing position.

6. Product dispensing apparatus comprising:

a housing having a product delivery compartment attached thereto;

frame means rotatably connected to said housing;

a first product column assembly attached to said frame means;

a first set of shelves pivotally attached to said first product column assembly, the shelves of said first set being oriented one above another, each of the shelves of said first set of shelves having a substantially horizontal product storing position and a non-horizontal dispensing position;

a second product column assembly attached to said frame means;

a second set of shelves pivotally attached to said second product column assembly, the shelves of said second set of shelves being oriented one above another, each of the shelves of said second set of shelves also having a substantially horizontal product storing position and a non-horizontal dispensing position;

means for rotating said frame means and thereby said first and second columns of shelves about a vertical axis between a selection position and at least one other rotational position;

delivery means attached to said housing for selectively causing the lowermost horizontally disposed shelf at said selection position to move to said non-horizontal dispensing position thereby delivering a product on said lowermost horizontally disposed shelf to said product delivery compartment;

a coin slot means attached to said housing;

coin receiving means for sensing the amount of money received in said coin slot means;

first vertically disposed post means attached to said frame means for indicating the price of products in the first set of shelves;

second post means attached to said frame means for indicating the price of products in the second set of shelves, said second post means being longer than said first post means;

first sensing means for sensing the presence of said first or second post means at a particular location when one of said columns of shelves is in the selection position;

second sensing means for sensing the presence of the second post means at a particular location when the second product column is in the selection position; and actuation means connected to said first and second sensing means for causing the delivery means to dispense a product from the first product column assembly when said first sensing means is in contact with said first vertically disposed post means and the coin receiving means indicates reception of the price for products in the first product column; and causing the delivery means to dispense a product from the second product column assembly when the first and second sensing means is in contact with the second post means and the coin receiving means indicates reception of at least the price of the product in the second product column.

7. The product dispensing apparatus of claim 6 wherein said actuation means prevents delivery of a product from said second product column assembly when the coin receiving mechanism indicates less than the price of the product in the second product column even though the first and second sensing means are in contact with the second post means.

8. The product dispensing apparatus of claim 6 wherein said second post means includes a first post member of approximately the size of said first post means and a second post member threadably engaged with the first post member whereby the price of product in the respective product column assembly can be set by removal from or addition of the second post member to the first post member.

* * * * *